US010236555B2

(12) United States Patent
Blödt

(10) Patent No.: US 10,236,555 B2
(45) Date of Patent: Mar. 19, 2019

(54) DEVICE FOR TRANSFERRING SIGNALS FROM A METAL HOUSING

(71) Applicant: Endress+Hauser GmbH+Co. KG, Maulburg (DE)

(72) Inventor: Thomas Blödt, Steinen (DE)

(73) Assignee: Endress+Hauser SE+Co. KG, Maulburg (DE)

( * ) Notice: Subject to any disclaimer, the term of this patent is extended or adjusted under 35 U.S.C. 154(b) by 100 days.

(21) Appl. No.: 15/534,724

(22) PCT Filed: Nov. 3, 2015

(86) PCT No.: PCT/EP2015/075542
§ 371 (c)(1),
(2) Date: Oct. 19, 2017

(87) PCT Pub. No.: WO2016/091481
PCT Pub. Date: Jun. 16, 2016

(65) Prior Publication Data

US 2018/0034129 A1 Feb. 1, 2018

(30) Foreign Application Priority Data

Dec. 11, 2014 (DE) ..... 10 2014 118 391

(51) Int. Cl.
*H01Q 1/22* (2006.01)
*H01Q 1/52* (2006.01)
*H01Q 1/12* (2006.01)

(52) U.S. Cl.
CPC ..... *H01Q 1/2233* (2013.01); *H01Q 1/225* (2013.01); *H01Q 1/521* (2013.01); *H01Q 1/1214* (2013.01)

(58) Field of Classification Search
CPC ..... H01Q 1/2233; H01Q 1/225; H01Q 1/521; H01Q 1/22; H01Q 1/52
(Continued)

(56) References Cited

U.S. PATENT DOCUMENTS 3,576,578 A 4/1971 Harper
5,982,327 A * 11/1999 Vook ..... H01Q 1/246 342/378
(Continued)

FOREIGN PATENT DOCUMENTS

CN 101223419 A 7/2008
DE 19922606 A1 12/2000
(Continued)

OTHER PUBLICATIONS

Search Report for German Patent Application No. 10 2014 118 391.6, German Patent Office, dated Jun. 26, 2016, 6 pp.
(Continued)

*Primary Examiner* — Lam T Mai
(74) *Attorney, Agent, or Firm* — Mark A. Logan; PatServe

(57) ABSTRACT

The present disclosure relates to a device for transferring signals from at least one housing opening of a housing, which is metallic at least in part, by means of electromagnetic waves of at least one specific wavelength. The device includes a transmitting/receiving unit arranged in the housing; at least one primary antenna arranged in the housing; a first secondary antenna for receiving the electromagnetic waves decoupled from the primary antenna; and a second secondary antenna for receiving the electromagnetic waves transferred from outside the housing, wherein the second secondary antenna is arranged outside the housing on the housing opening, wherein a reflection point is arranged between the first and second secondary antennas, such that an impedance jump occurs between the first and second secondary antennas.

12 Claims, 4 Drawing Sheets

(58) Field of Classification Search
USPC ..... 343/702, 806
See application file for complete search history.

(56) References Cited

U.S. PATENT DOCUMENTS

| | | | | |
|---|---|---|---|---|
| 6,822,611 | B1 * | 11/2004 | Kontogeorgakis | H01Q 1/243 343/702 |
| 6,995,715 | B2 * | 2/2006 | Ying | H01Q 1/243 343/702 |
| 7,277,058 | B2 * | 10/2007 | Faraone | H01Q 1/242 343/702 |
| 7,453,406 | B2 * | 11/2008 | Chenoweth | H01Q 1/243 343/700 MS |
| 7,479,927 | B2 * | 1/2009 | Scarpelli | H01Q 1/243 343/700 MS |
| 7,482,981 | B2 * | 1/2009 | Goldberg | H01Q 1/241 343/701 |
| 7,548,208 | B2 * | 6/2009 | Dou | H01Q 21/28 343/702 |
| 8,064,960 | B2 * | 11/2011 | Wisnewski | H01Q 1/3208 455/562.1 |
| 2006/0022877 | A1 * | 2/2006 | Goldberg | H01Q 1/241 343/701 |
| 2006/0145930 | A1 * | 7/2006 | Faraone | H01Q 1/242 343/702 |
| 2006/0158371 | A1 | 7/2006 | Duivenvoorden | |
| 2008/0158070 | A1 * | 7/2008 | Chenoweth | H01Q 1/243 343/702 |
| 2012/0153969 | A1 | 6/2012 | Eckert et al. | |

FOREIGN PATENT DOCUMENTS

| | | | |
|---|---|---|---|
| DE | 102006030965 | A1 | 1/2008 |
| EP | 2646782 | A1 | 10/2013 |

OTHER PUBLICATIONS

Search Report for International Patent Application No. PCT/EP2015/075542, WIPO, dated Jan. 20, 2016, 12 pp.

* cited by examiner

DEVICE FOR TRANSFERRING SIGNALS FROM A METAL HOUSING

CROSS-REFERENCE TO RELATED APPLICATION

The present application is related to and claims the priority benefit of German Patent Application No. 10 2014 118 391.6, filed on Dec. 11, 2014 and International Patent Application No. PCT/EP2015/075542, filed on Nov. 3, 2015, the entire contents of which are incorporated herein by reference.

TECHNICAL FIELD

The invention relates to a device according to the preamble in claim 1.

BACKGROUND

In automation—especially, in process automation—field devices are widely used that serve for the determination, optimization, and/or influencing of process variables. Sensors, such as level-measuring instruments, flow meters, pressure and temperature measuring instruments, conductivity meters, etc., which capture the corresponding process variables of level, flow, pressure, temperature, and conductivity, are used for the detection of process variables. Actuators, such as valves or pumps, are used to influence process variables and can be used to alter the flow of a fluid in a pipe section or the fill-level in a container. Field devices, in general, refer to all devices which are process-oriented and which provide or handle process-relevant information. In connection with the invention, field devices are thus understood to include remote I/O's (electrical interfaces), wireless adapters, or general devices that are arranged at the field level. A variety of such field devices are manufactured and marketed by the Endress+Hauser company. RFID systems are used, for example, to identify field devices.

An RFID system is made up of a transponder, which is located in a housing and contains a distinctive code, as well as a reader for reading this identifier. An NFC system additionally enables an opposite information path and, for example, the transmission of one or several measured values of a field device or an interconnection of multiple field devices. The disadvantage of RFID and NFC transponders is that the conductive housing of the field devices is essentially impermeable to electromagnetic waves in the range necessary for RFID.

SUMMARY

The aim of the invention is to create a device that improves the transmission of RFID or NFC signals from a metallic housing.

The aim is achieved according to the invention by the subject matter of the invention. The subject matter of the invention is a device for transferring signals from at least one housing opening of a housing, which is metallic at least in part, by means of electromagnetic waves of at least one specific wavelength, comprising a transmitting/receiving unit arranged in the housing for generating and receiving the electromagnetic waves; at least one primary antenna arranged in the housing for decoupling the generated electromagnetic waves of the transmitting/receiving unit and for coupling and transferring received electromagnetic waves to the transmitting/receiving unit; a first secondary antenna for receiving the electromagnetic waves decoupled from the primary antenna, wherein the first secondary antenna is arranged within the housing on the housing opening; and a second secondary antenna for receiving the electromagnetic waves transferred from outside the housing, wherein the second secondary antenna is arranged outside the housing on the housing opening, wherein a reflection point is arranged between the first and second secondary antennas, such that an impedance jump occurs between the first and second secondary antennas.

The electromagnetic waves transmitted by the primary antenna couple to the first secondary antenna within the housing and then transfer from the first secondary antenna to the second secondary antenna outside of the housing and are decoupled from the second secondary antenna. The transfer from the housing interior to the housing exterior is accomplished by guided waves, the loss of which is less than that of free waves.

According to an advantageous embodiment, the housing opening has a cable gland—especially, a PG cable gland.

According to an advantageous embodiment, the cable gland is filled at least partially with a dielectric filling material—especially, a dielectric sealing compound. The dielectric filling material protects the electromagnetic waves emitted by the first or second secondary antenna, thereby reducing the losses. In addition, the filling material ensures an impermeability in the housing—for example, through the use of glass in a pressure-resistant field device. According to an advantageous variant, the filling material holds first and second secondary antennas inside the cable gland. Thus, no retaining means are required for the first and second secondary antennas.

According to an advantageous further development, the reflection point is designed as an abrupt change from the diameter of the first secondary antenna to the diameter of the second. An abrupt change in the diameter causes a change in the wavelength of electromagnetic waves transferred from the first to the second secondary antenna and vice versa.

According to an advantageous further development, the reflection point is designed as a shared antenna base of the first and second antennas. The shared antenna foot decouples the first secondary antenna from the second.

According to an advantageous variant, the shared antenna base has a plate-shaped design, wherein the antenna base defines a first plane, wherein a wall having the housing opening defines a second plane, and wherein the first and the second planes are identical. The distributions of the electromagnetic fields of the first and second secondary antennas have a minimal disruptive effect on these.

According to an advantageous embodiment, the first and/or second secondary antenna(s) has/have a length that corresponds to a whole number multiple of one fourth of at least one specific wavelength. This results in a low-loss transmission from the first to the second secondary antenna and vice versa.

According to an advantageous embodiment, the first and/or second secondary antenna(s) has/have a length that corresponds to one fourth of at least one specific wavelength. This results in a low-loss transmission from the first to the second secondary antenna and vice versa. In this way, electromagnetic waves of multiple wavelengths, which can also be present in different frequency bands, can be received and sent by the first or second secondary antenna. For this purpose, the wavelengths must be in an even-numbered ratio to one another.

According to an advantageous embodiment, the first and/or second secondary antenna(s) are/is each rounded at an open end lying opposite the reflection point. In this way, it is possible to produce the wavelengths of a frequency band that pass into the first and/or second secondary antenna(s) and thereby achieve a broad-bandedness.

BRIEF DESCRIPTION OF THE DRAWINGS

The invention is explained in more detail based upon the following drawings. Illustrated are.

DETAILED DESCRIPTION

Figure 1:
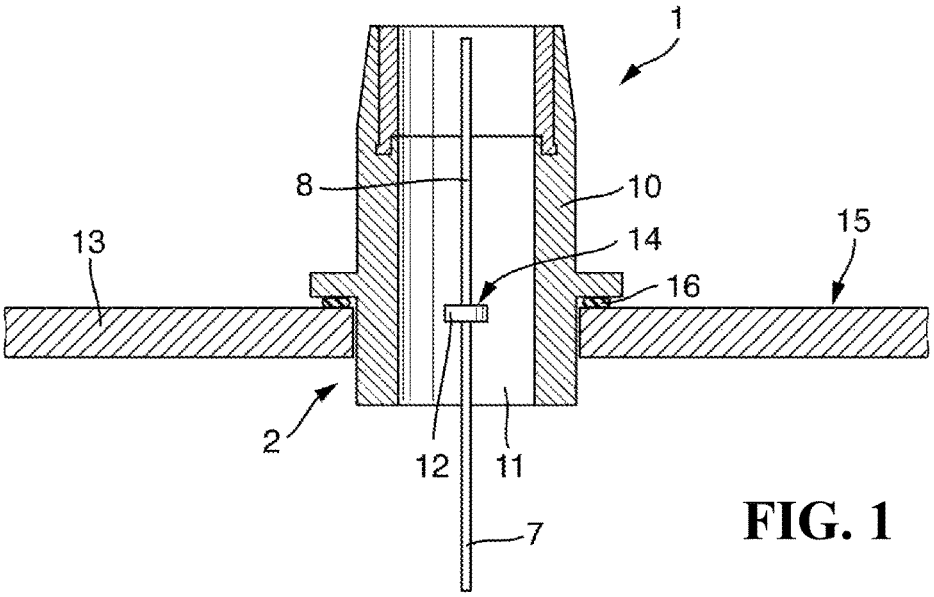
FIG. 1 shows a longitudinal section of a device for the transmission of signals from a metallic housing.

FIG. 1 shows a longitudinal section of a device 1 for the transmission of electromagnetic waves from a metallic housing (not depicted). A wall 13 of the housing has a housing opening 2 in which a cable gland 10 is arranged. Cable gland 10 has a hollow cylindrical design and is arranged in large part outside of the housing. A rubber seal 16 seals cable gland 10 against wall 13 in a water-tight manner. A plate-like antenna base 12, which has first and second lateral faces, is arranged inside cable gland 10. A first lateral face, which faces outside of the housing, defines a first plane 14. An outer face of the housing defines a second plane 15. First and second planes 14, 15 may be identical. This is achieved using a filling material 11 that fills an inner space of cable gland 10 and holds antenna base 12 in a position in which first and second planes 14, 15 are identical. Furthermore, filling material 11 seals housing opening 2 in a water-tight manner. Filling material 11 comprises a dielectric material, such as plastic, glass, or ceramics.

A first rod-shaped secondary antenna 7 (diameter approx. 1.5 mm) is arranged on the first lateral surface of antenna base 12 and points in the direction of the housing exterior. A second rod-shaped secondary antenna 8 is arranged on the second lateral surface of antenna base 12 and points in the direction of the housing interior. In this way, first and second secondary antennas 7, 8 have antenna base 12 as a shared antenna base 12. Antenna base 12 functions as a reflection point between first and second secondary antennas 7, 8, such that an impedance jump occurs between first and second secondary antennas 7, 8.

The lengths of first and second secondary antennas 7, 8 are selected such that the lengths correspond to a multiple of one fourth of a wavelength of the electromagnetic waves to be transmitted (e.g., 2.44 GHz at Bluetooth 4.0 low energy). However, the length of first and second secondary antennas 7, 8 may be exactly one fourth of the electromagnetic wavelength by means of which the signals are to be transmitted from the metallic housing. This is especially advantageous for electromagnetic waves of the wavelength in a range of 2.4 GHz (ANT, ANT+, Bluetooth, WLAN).

Due to shared antenna base 12 of first and second antennas 7, 8, a narrow-bandedness of the electromagnetic wave to be transmitted is achieved. As a result, disturbances can be prevented. A good impedance adjustment of first secondary antenna 7 to second secondary antenna 8 is achieved by use of a thick pin as first or secondary antenna 7, 8.

If the open ends of the first or second secondary antenna are rounded, an expanded surface and, thus, an improved decoupling of the electrical field results.

Figure 2:
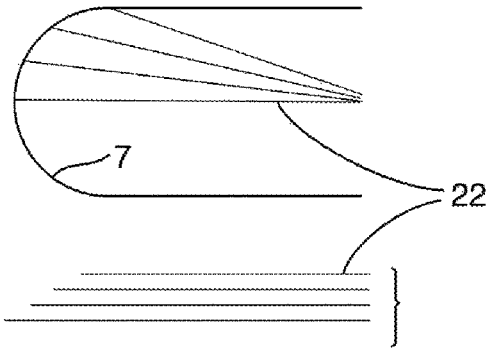
FIG. 2 shows a schematic longitudinal section of a first or second secondary antenna at a rounded open end.

FIG. 2 shows a schematic longitudinal section of a first or second secondary antenna 7 at a rounded open end. If the open ends of the first or second secondary antenna are rounded, different lengths result for the distance between the reflection point and the open ends of the first and second secondary antennas. The result of this is that, not only electromagnetic waves of a certain wavelength, but, rather, electromagnetic waves having wavelengths that define a fluent range of a frequency band pass into the respective secondary antenna. This yields a broad-bandedness of the electromagnetic waves.

Figure 3A:
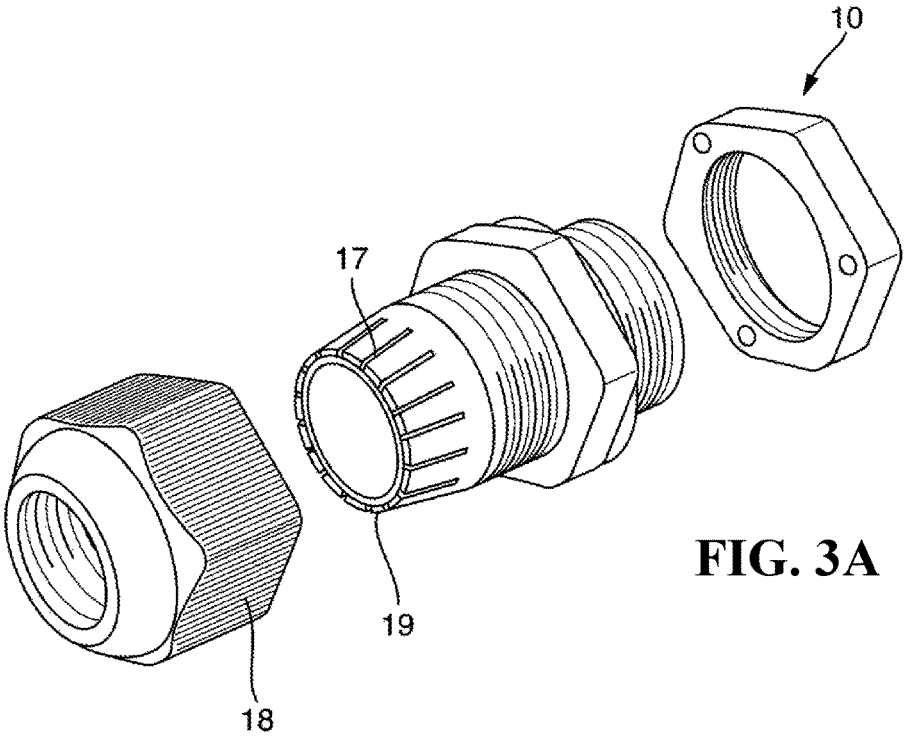
FIG. 3 shows a side view of a PG cable gland in exploded view and in assembled view.
Figure 3B:
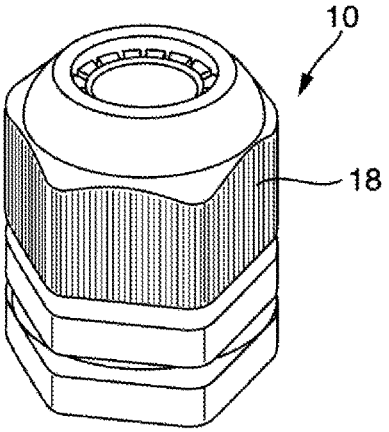

FIG. 3 shows a side view of a cable gland 10 that is designed as a PG cable gland—once in exploded view and once in assembled view. Cable 10 gland has tines at an outer end 17 that, together with a fastening nut 18, result in a more secure hold of a cable to be routed in cable gland 10 ("strain relief"). A second rubber seal 19 results in a water-tight cable gland 10.

If a cable gland 10 made of plastic is attached to a housing made of metal, this represents a transmission possibility for waves, in case no cable is screwed into such a cable gland 10. Housings of field meters typically have at least one housing opening, in order to install PG cable glands. Multiple housing openings offer the advantage that there are multiple possibilities for introducing the cable into the field device. This is especially important for installations in the US, because the cabling typically must be laid in a metal conduit (armored conduit), and these are very inflexible. Moreover, this enables a cascading of field meters. This reduces the required cabling effort. In the devices, suitable bus systems are provided, for example, in order to transmit measurement data across other devices. For this purpose, the devices have connections for at least two cables.

Advantageously, one of the unused cable glands is used for the transmission of electromagnetic waves. This has the advantage that the housing openings in the existing housings are already available, and the housings do not need to be modified. Unused cable glands can be sealed off with a so-called filler plug.

Figure 4:
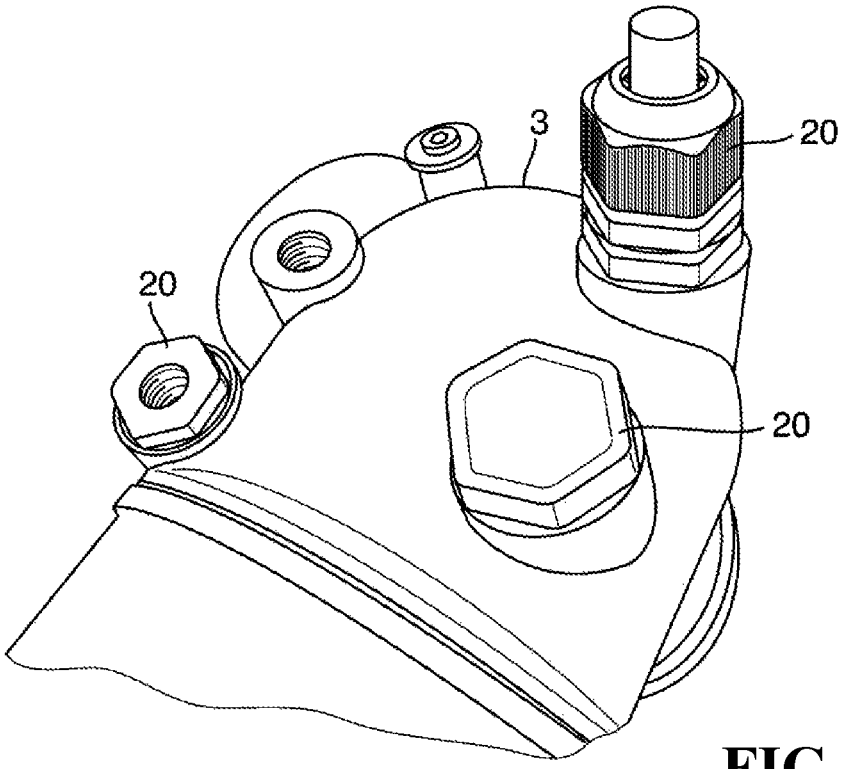
FIG. 4 shows a side view of a housing of a field device having three different types of filler plugs.

FIG. 4 shows a side view of a metallic housing of a field device having three different types of filler plugs 20 made of plastic. Filler plugs 20 are each installed on a metallic housing of the device or product series having the trade name Micropilot of the applicant.

If a filler plug 20 made of a dielectric plastic is arranged in a housing opening of a metallic housing, the housing opening represents a round-hole conductor for electromagnetic waves. In the case of a filler plug 20 having a diameter of 19 mm, the lower cutoff frequency of the electromagnetic waves transmitted through the housing opening is approximately 79 GHz, i.e., lower frequencies cannot pass through the housing opening. Typical frequencies for local communication are typically around 2.4 GHz (WLAN, Bluetooth, ANT) or on the order of 433 MHz, 5.6 GHz, and so on. Frequencies falling substantially below this (e.g., NFC/RFID at 13.6 MHz) cannot pass through the housing opening. Through a cable, the lower transmission frequency increases by a factor of 2-4 (in the case of shielded cables, substantially more). For electromagnetic waves having frequencies above the lower transmission frequency, a passage through the housing opening is possible, but is generally sharply attenuated and offers good permeability starting at a frequency that is only approximately 6-10 times higher (in the case of a housing opening with a 19 mm diameter, starting at 600 GHz).

Figure 5:
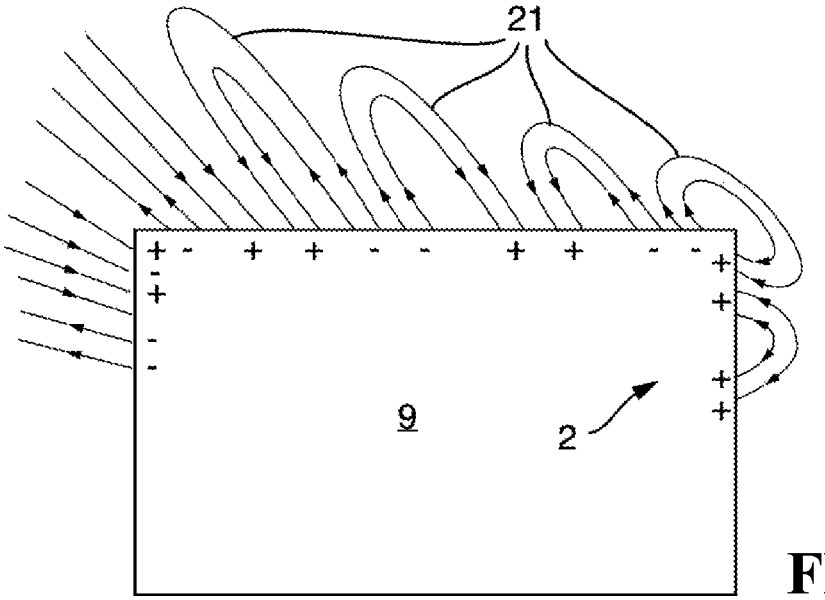
FIG. 5 shows a schematic longitudinal section of a housing having outgoing and incoming field lines of an electric field and FIG. 6 shows a sketched longitudinal section of a first and second antenna having a reflection point between them.

FIG. 5 shows a schematic longitudinal section of a housing 9 having outgoing and incoming field lines 21 of an electric field. A field distribution of electric field lines 21 explains the effect of how the signals can be transmitted via the electromagnetic waves to a side of housing 9 situated opposite housing opening 2.

Figure 6:
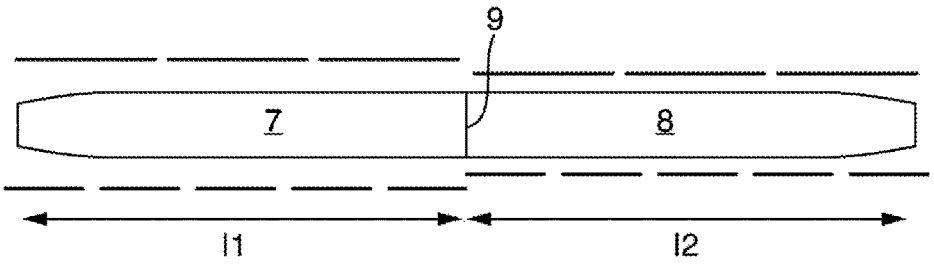

FIG. 6 shows a sketched longitudinal section of first and second secondary antennas 7, 8 having a reflection point 9 situated between them. Through first and second secondary antennas 7, 8, only electromagnetic waves are transmitted that form a standing wave in the first and second secondary antennas 7, 8. This means that a whole number multiple of one fourth of the wavelength of the electromagnetic wave to be transmitted must correspond to lengths I1 and I2 of the first and second secondary antennas 7, 8. In this scenario, first and second secondary antennas 7, 8 can have different lengths I1 and I2.

LIST OF REFERENCE CHARACTERS

1 Device
2 Housing opening
3 Housing
4 Electromagnetic waves
5 Transmission/receiving unit
6 Primary antenna
7 First secondary antenna
8 Second secondary antenna
9 Reflection point
10 Cable gland
11 Dielectric filling material
12 Antenna base
13 Housing wall
14 First plane
15 Second plane
16 Rubber seal
17 Tines
18 Fastening nut
19 Second rubber seal
20 Filler plugs
21 Field lines
22 Wavelength

The invention claimed is:

1. A device for enabling wireless communication with a field device, comprising:

a transmitting and receiving unit disposed in a field device housing and embodied to generate and to receive electromagnetic waves from an opening in the field device housing, which is metallic at least in part;

a primary antenna disposed in the housing embodied to decouple the generated electromagnetic waves of the transmitting and receiving unit and to couple and transfer the received electromagnetic waves to the transmitting and receiving unit;

a first secondary antenna embodied to receive the generated electromagnetic waves decoupled from the primary antenna, the first secondary antenna disposed within the housing in the housing opening; and a second secondary antenna embodied to receive electromagnetic waves transferred from outside the housing, the second secondary antenna disposed outside the housing in the housing opening, wherein the first secondary antenna is joined to the second secondary antenna at a reflection point between the first and second secondary antennas, such that an impedance jump occurs between the first and second secondary antennas.

2. The device of claim 1, further comprising a cable gland disposed within the housing opening.

3. The device of claim 2, wherein the cable gland is a PG cable gland.

4. The device of claim 2, wherein the cable gland is filled at least partially with a dielectric filling material.

5. The device of claim 4, wherein the dielectric filling material is a dielectric sealing compound.

6. The device of claim 4, wherein the first and second secondary antennas are held inside the cable gland by the filling material.

7. The device of claim 1, wherein the reflection point is embodied as an abrupt change in a diameter of the first secondary antenna to a diameter of the second secondary antenna.

8. The device of claim 1, wherein the reflection point is embodied as a shared antenna base of the first and second secondary antennas.

9. The device of claim 8, wherein the shared antenna base has a plate-shaped form, and wherein the shared antenna base is disposed such that a first plane defined by the shared antenna base and a second plane defined by a wall of the housing at the housing opening coincide.

10. The device of claim 1, wherein the first secondary antenna, the second secondary antenna, or both secondary antennas have a length that corresponds to a whole-number multiple of one quarter of at least one specific wavelength.

11. The device of claim 1, wherein the first secondary antenna, the second secondary antenna, or both secondary antennas are rounded at an open end opposite the reflection point.

12. A device for enabling wireless communication with a field device, comprising:

a transmitting and receiving unit disposed within a field device housing;

a primary antenna disposed within the field device housing and embodied to couple electromagnetic waves with the transmitting and receiving unit; and a secondary antenna including a first part and a second part, the first part disposed in the field device housing and the second part disposed outside the field device housing via an opening in the field device housing, the first part and the second part joined to each other at a reflection point at which there is an impedance change between the first part of the secondary antenna and the second part of the secondary antenna, wherein the first part of the secondary antenna is embodied to transfer electromagnetic waves between the primary antenna and the second part of the secondary antenna, and wherein the second part of the secondary antenna is embodied to transfer electromagnetic waves between the first part of the secondary antenna and a device external to the field device housing.

* * * * *